US007168100B2

(12) United States Patent
Kronenberger

(10) Patent No.: US 7,168,100 B2
(45) Date of Patent: Jan. 30, 2007

(54) HEADWEAR PIECE WITH ASSOCIATED RIM

(75) Inventor: Ronald Kronenberger, Riverwoods, IL (US)

(73) Assignee: American Needle, Buffalo Grove, IL (US)

( * ) Notice: Subject to any disclaimer, the term of this patent is extended or adjusted under 35 U.S.C. 154(b) by 21 days.

(21) Appl. No.: 10/794,612

(22) Filed: Mar. 4, 2004

(65) Prior Publication Data

US 2005/0193469 A1 Sep. 8, 2005

(51) Int. Cl.
*A42B 1/00* (2006.01)

(52) U.S. Cl. ..... 2/175.4; 2/195.6; 2/195.1; 2/171.03; 2/175.1; 2/175.3; 2/195.5; 2/200.1; 2/209.12

(58) Field of Classification Search ..... 2/195.6, 2/195.1, 171.03, 175.1, 175.4, 195.5, 200.1, 2/209.12, 175.3, 175.5
See application file for complete search history.

(56) References Cited

U.S. PATENT DOCUMENTS 61,451 A * 1/1867 Pease ..... 2/200.1
1,300,535 A * 4/1919 Whist ..... 442/181
1,750,231 A * 3/1930 Lifton ..... 442/257
2,237,344 A * 4/1941 Evans et al. ..... 442/261
2,678,448 A * 5/1954 Rosenzweig ..... 2/209.11
3,280,406 A * 10/1966 Immel ..... 2/181
6,076,192 A * 6/2000 Kronenberger ..... 2/195.6
6,115,845 A * 9/2000 White ..... 2/195.1
6,138,279 A * 10/2000 Gore ..... 2/175.5
6,408,443 B1 * 6/2002 Park ..... 2/195.1

* cited by examiner

*Primary Examiner*—Gary L. Welch
*Assistant Examiner*—Alissa J. Tompkins
(74) *Attorney, Agent, or Firm*—Wood, Philips, Katz, Clark & Mortimer

(57) ABSTRACT

A headwear piece has a crown defining a receptacle for the head of a wearer and a rim projecting angularly away from the crown. The rim has a core layer that is made from at least one of an animal hide and a synthetic animal hide, and a second layer. The core layer has an upwardly facing surface and a downwardly facing surface and at least part of one of the upwardly facing surfaces and downwardly facing surfaces is covered by the second layer.

28 Claims, 6 Drawing Sheets

HEADWEAR PIECE WITH ASSOCIATED RIM

BACKGROUND OF THE INVENTION

1. Field of the Invention

This invention relates to headwear and, more particularly, to a headwear piece having a crown and a rim projecting angularly away from an external surface of the crown.

2. Background Art

One of the most popular pieces of headwear is the baseball-style cap. The baseball-style cap has an inverted, cup-shaped crown to receive the head of a wearer and a forwardly projecting bill/rim which is directed angularly away from the crown at a front portion thereof. Baseball-style caps have continued to evolve, appealing to an ever-increasing base of consumers. What once was designed primarily for baseball players has become regular garb for many on a day-to-day basis.

The popularity of the baseball-style cap has made it the focus of many headwear designers. While the basic configuration has remained the same over the decades, many modifications have been devised in terms of the materials used to construct the cap, the manner of assembling the cap, the adornment thereon, etc. The market for baseball-style caps is highly competitive and continues to inspire those involved therein to make new developments to appeal to an even larger consumer group.

One particularly desirable feature of the baseball-style cap is that, while highly functional, it has an unobtrusive configuration and is light in weight. The crown affords the wearer an effective barrier against the elements, with the rim, in addition to shielding the user's face from rain, and the like, shades the user's eyes from sunlight in a manner that does not significantly obstruct the user's forward and peripheral vision.

By reason of its construction, the baseball-style cap also lends itself to being compactly transported by the wearer, when not in use. Typically, the crown is constructed from sewn cloth gores. The crown can be very simply folded or pressed into a compact state. Once the cap is replaced on the wearer's head, the crown assumes a neat conforming shape that generally does not appear wrinkled, creased, or otherwise disfigured to evidence the compaction.

The most significant impediment to compaction of the baseball-style cap is the rim. Typically, the rim includes a core layer that is sufficiently shape retentive that the crown will have a relatively consistent, bowed shape which produces a convex curvature at the top, exposed surface of the rim. It is common to construct the core layer of the rim from plastic, cardboard, or other like material that tends to retain a shape into which it is formed at manufacture.

In competition with the objective of having a shape-retaining rim is that of allowing the rim to be reconfigured compactly when the headwear is not in use. Ideally, the rim would be either foldable or rollable towards, or into, a compact cylindrical shape around a fore-and-aft axis. However, as the rim is folded or bent towards the cylindrical shape, there is a significant resistance due to the stiff nature of the material defining the core layer of the rim. As a result, a significant compaction of the rim may cause a permanent deformation of the core layer. In a worst case, the core layer may rupture. In either event, a permanent deformation of the rim may be imparted, which detracts significantly from the appearance of the cap.

One solution to this problem is presented in U.S. Pat. No. 6,076,192, owned by the assignee herein. In this patent, the core of the bill/rim is made from a resilient layer which has shape-retentive characteristics but is also readily conformable.

The industry continues to seek out rim constructions that will be sufficiently shape retentive to maintain a desired appearance for the headwear, yet which can be deformed for compaction, as when it is desired to store or transport the cap.

SUMMARY OF THE INVENTION

The invention is directed to a headwear piece having a crown defining a receptacle for the head of a wearer and a rim projecting angularly away from the crown. The rim has a core layer, that is made from at least one of an animal hide and a synthetic animal hide, and a second layer. The core layer has an upwardly and downwardly facing surface. At least part of one of the upwardly and downwardly facing surfaces is covered by the second layer.

In one form, the core layer has a thickness in the range of 1/16–1/4 inch.

In one form, the second layer is applied to the upwardly facing surface of the core layer.

The second layer may be a cloth material. Alternatively, the second layer may be at least one of an animal hide and a synthetic animal hide.

In another form, the second layer is applied to the downwardly facing surface of the core layer.

The second layer applied to the downwardly facing surface of the core layer may be a cloth material.

In one form, there are separate layers applied to the upwardly facing surface and the downwardly facing surface of the core layer.

One or both of the layers applied to the core layer may be made from a cloth material.

In one form, an upwardly facing surface of the rim has an area and the core layer extends continuously over substantially the entire area of the upwardly facing surface of the rim.

The rim may extend around only a portion of the crown or fully around the crown.

In one form, the headwear piece is a baseball-style cap.

The crown may have a top opening through which a top region of a wearer's head is exposed with the headwear piece operatively positioned on the wearer's head.

In one form, the core and second layers are joined to each other, as by use of an adhesive or stitching.

The core and second and third layers may likewise be joined to each other, as by use of an adhesive or stitching.

In one form, the rim has a thickness, with the core layer having a thickness equal to at least 1/2 of the thickness of the rim.

The core layer may have a thickness equal to at least 2/3 the thickness of the rim.

The animal hide defining the core layer may be dressed.

In one form, the rim has a second layer that is made from at least one of an animal hide and a synthetic animal hide.

In one form, the second layer covers substantially the entirety of the at least one of the upwardly and downwardly facing surfaces of the core layer.

BRIEF DESCRIPTION OF THE DRAWINGS

FIGS. 9–17 correspond to FIG. 5 and show different compositions for the inventive rim with: FIG. 9 showing a layer of animal hide or synthetic animal hide with one surface partially covered by a cloth layer; FIG. 10 showing a cloth layer applied to the downwardly facing surface of a hide layer; FIG. 11 showing a cloth layer applied to the upwardly facing surface of a hide layer; FIG. 12 showing two hide layers; FIG. 13 showing a cloth layer applied to the upwardly facing surface of the combined hide layers of FIG. 12; FIG. 14 showing the layers in FIG. 10 joined by an adhesive; FIG. 15 showing the layers in FIG. 10 joined by stitching; FIG. 16 showing hide layers joined by stitching and a cloth layer adhesively bonded to the downwardly facing surface of the combined hide layers; and FIG. 17 showing three hide layers;

DETAILED DESCRIPTION OF THE DRAWINGS

Figure 1:
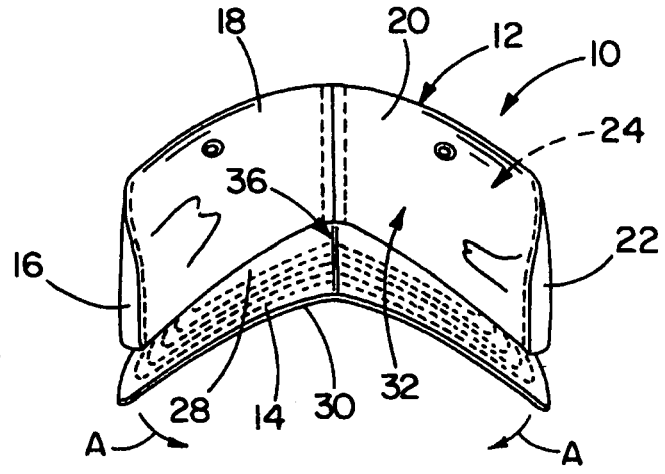
FIG. 1 PRIOR ART
FIG. 1 is a front elevation view of a conventional baseball-style cap having a crown and a rim extending forwardly from the crown.
Figure 2:
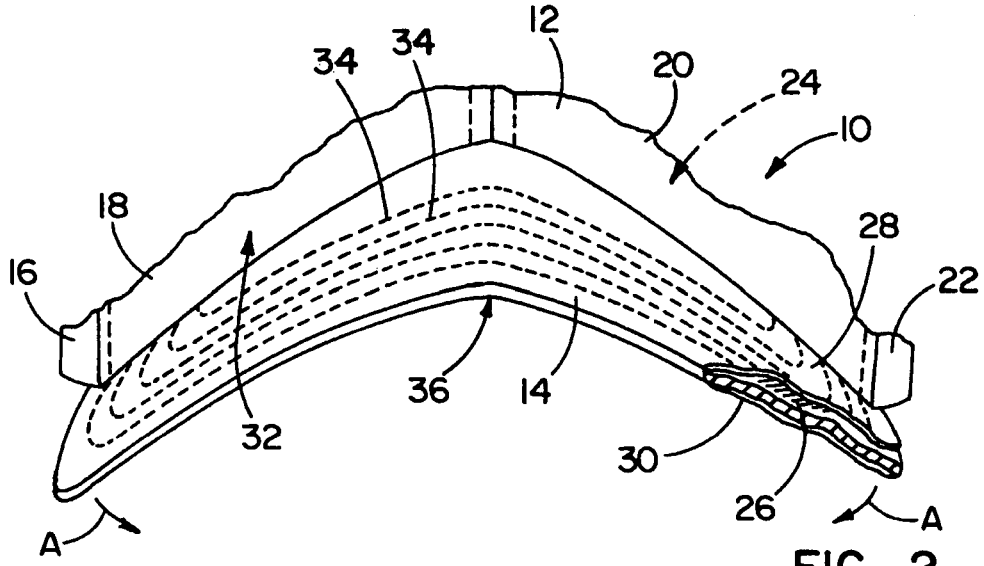
FIG. 2 PRIOR ART
FIG. 2 is an enlarged, fragmentary, front elevation view of the cap in FIG. 1 with the rim broken away to identify its component layers.

In FIGS. 1 and 2, a conventional baseball-style cap is shown at 10. The cap 10 consists of a crown 12 and a rim/bill 14 projecting forwardly from the crown 12 at the front thereof. The crown 12 has a plurality of cloth gores 16,18, 20,22, sewn edge-to-edge to cooperatively produce an inverted, cup-shaped receptacle 24 for the head of a wearer.

The rim 14 is defined by a core layer 26 that is made from a shape-retentive material, such as hard plastic, cardboard, or the like. The plastic may be, for example, extruded polyethylene foam having a thickness on the order of 1/16 inch. The core layer 26 is sandwiched between two cloth layers 28,30, which extend rearwardly to beyond the core layer 26 for attachment to a front wall 32 on the crown 12. Lines of stitching 34 pass through the cloth layers 28,30 and core layer 26 to securely join the layers 28,30 and layer 26. The cloth layers 28,30 and core layer 26 are united with each other and the crown 12 in such a manner that the rim 14 assumes an inverted, bowed, or "U" shape, as viewed from the front of the cap 10.

As noted in the Background portion herein, it is common for a wearer of a baseball-style cap, of the type shown at 10, to compact the cap 10 by forming the rim towards a cylindrical shape around a fore-and-aft axis, as shown in FIGS. 1 and 2. While the conventional materials used for the rim 14 have a certain amount of shape memory, the core layer 26 is prone to becoming permanently deformed. As shown in this particular embodiment, the deformation of the rim 14 towards a cylindrical shape, as indicated by the arrows A in FIGS. 1 and 2, can produce a permanent crease at 36. The crease 36 may result from a partial rupture of the material defining the core layer 26 or by reason of a molecular rearrangement that compromises the elasticity of the material defining the core layer 26. As a result, a residual peak may be formed in the rim 14, which precludes its ability to maintain the desired curved shape that is set at the time of manufacture.

Figure 3:
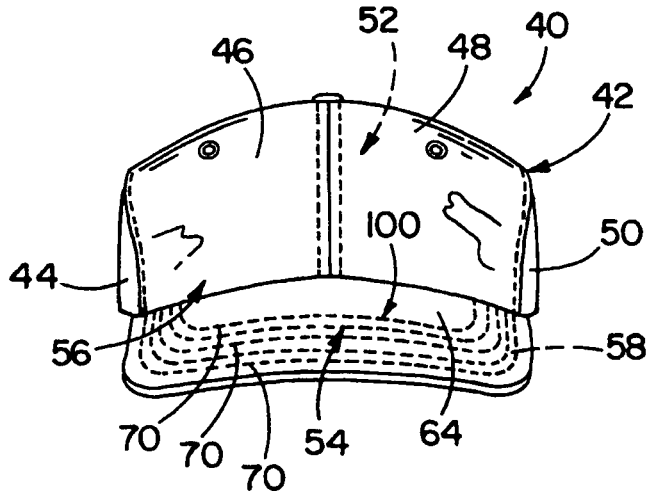
FIG. 3 is a view as in FIG. 1 of a headwear piece, according to the present invention, and including a crown and rim projecting angularly from the crown at the front thereof.
Figure 4:
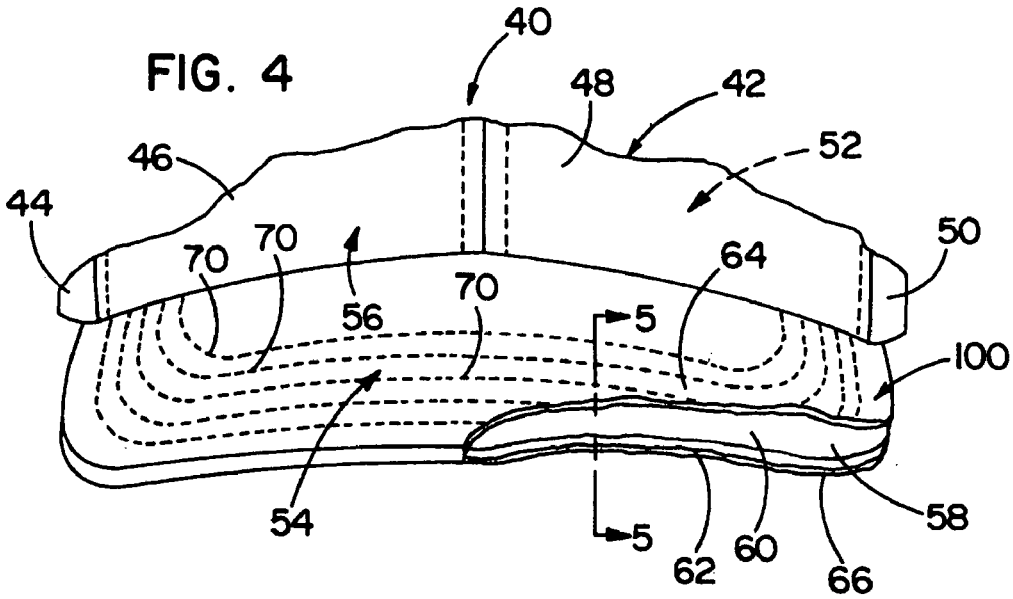
FIG. 4 is an enlarged, fragmentary, front elevation view of the headwear piece in FIG. 3 and broken away to expose the component layers defining the rim.
Figure 5:
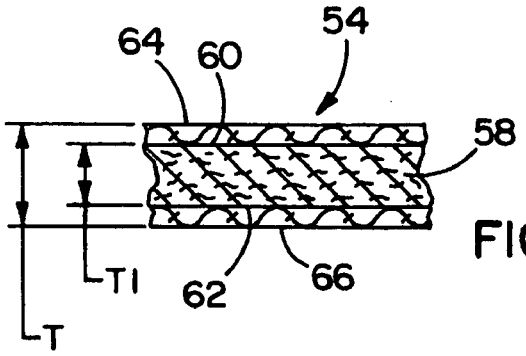
FIG. 5 is an enlarged, cross-sectional view of the rim taken along 5—5 of FIG. 4.

One form of headwear piece, according to the present invention, is shown at 40 in FIGS. 3–5 in the form of a baseball-style cap. As explained in greater detail below, the inventive concept is not limited to incorporation into a baseball-style cap.

The cap 40 has a crown 42 defined by cloth gores 44,46,48,50, sewn edge-to-edge as on the prior art crown 12, to produce an inverted cup shape defining a receptacle 52 for the head of a wearer.

A rim 54 projects angularly away from the crown 42 at the front region 56 thereof. The rim 54, as seen also in FIG. 5, consists of a core layer 58 that is made from either an animal hide or a synthetic animal hide. Preferably, an animal hide that has been dressed is utilized for the core layer 58. The animal hide can be treated and incorporated into the rim 54 in such a manner that the rim 54 has good shape-retentive properties. At the same time, the animal hide lends itself to being conveniently rolled towards, and into, a cylindrical shape without significantly diminishing its shape-retentive capabilities. At the same time, the hide material is not prone to being damaged by water, or other environmental conditions typically encountered in normal use by a wearer.

The core layer 58 has an upwardly facing surface 60 and a downwardly facing surface 62 to which cloth layers 64,66 are respectively applied. In this case, adjacent lines of stitching 70 are formed through all of the layers 58,64,66 to join the layers so as to define a unitary rim structure. The layers 64,66, when joined in this manner to each other and the core layer 58, add rigidity to the rim 54 and add to its shape-retentive properties, without significantly affecting the ability of the rim 54 to be rolled compactly into a cylindrical shape about a fore-and-aft axis. The cloth layers 64,66 can be made of the same material, or different materials. Cloth materials suitable for use in the layers 64,66 are well known to those skilled in this art.

Layers, to be applied to the core layer 58, made from virtually a limitless number of other, different materials are also contemplated. For simplicity, layers identified as "cloth" herein are intended to encompass not only what is technically under the definition of a "cloth", but any thin conformable layer made from any other type of material such as plastic, cardboard, etc., and potentially even an applied coating that cures as a discrete "layer".

The rim 54 has an overall thickness T, with the core layer 58 having a thickness T1. The thickness T1 is preferably in the range of 1/16–1/4 inch. However, thicknesses lesser than 1/16 inch and greater than 1/4 inch are contemplated. The thickness T1 is preferably at least 1/2 of the overall thickness T and may be on the order of 2/3 the thickness T, or greater.

Figure 6:
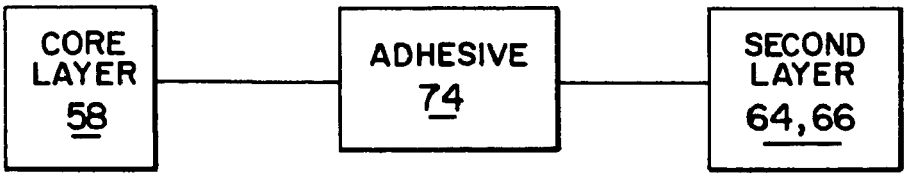
FIG. 6 is schematic representation of one form of rim, according to the present invention, defined by layers joined by an adhesive.

As shown in FIG. 6, as an alternative means of joining the layers 58,64,66, an adhesive 74 may be employed.

Figure 7:
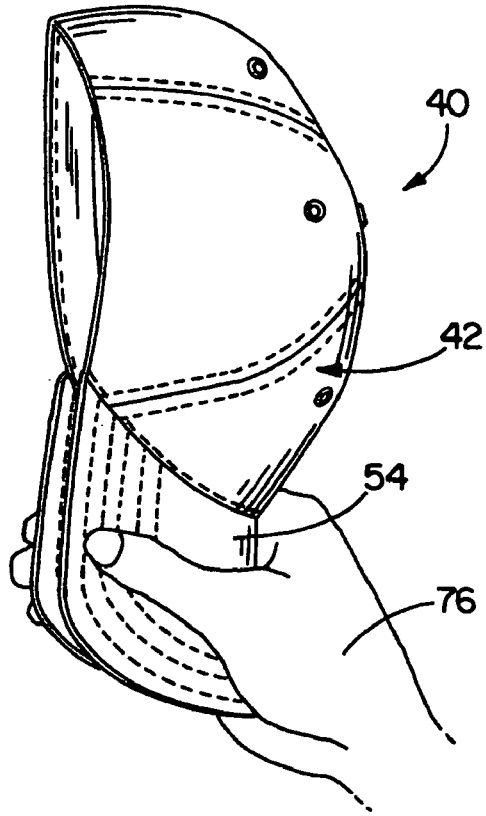
FIG. 7 is a side elevation view of the inventive headwear piece in FIGS. 3 and 4 with the rim thereon being grasped and reconfigured by a user for compaction of the headwear piece.
Figure 8:
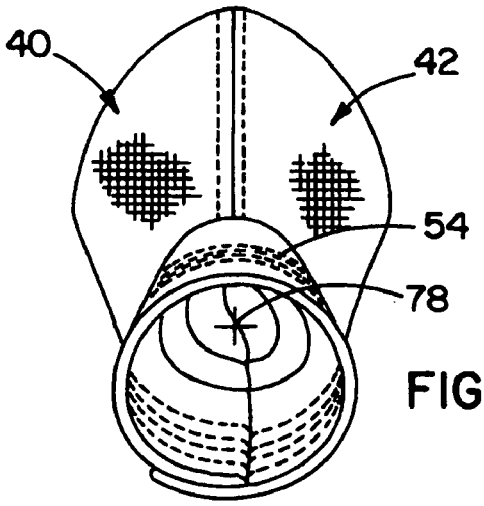
FIG. 8 is a front elevation view of the headwear piece in FIGS. 3, 4 and 7 and with the rim rolled into a compact cylindrical shape.

With the above-described structure, and that described in other embodiments below, compacting of the rim 54, in the manner shown in FIGS. 7 and 8, is facilitated. As seen in those figures, a user can grasp and compact the rim 54 in his/her hand 76 in a manner that the rim 54 tends towards a cylindrical shape about a fore-and-aft axis 78. The user's hand 76 functions as a constrictable loop. Whereas conventional caps have rims that tend to be less compliant as the rims thereon are deformed towards a cylindrical shape, the rim 54 tends to "roll", under a surrounding, constricting force, into a cylindrical shape. As shown in FIG. 8, the rim 54 ultimately assumes a continuous cylindrical shape that can be reduced to a relatively small diameter.

The invention contemplates many other compositions for the rim 54, as shown in FIGS. 9–17.

Figure 9:
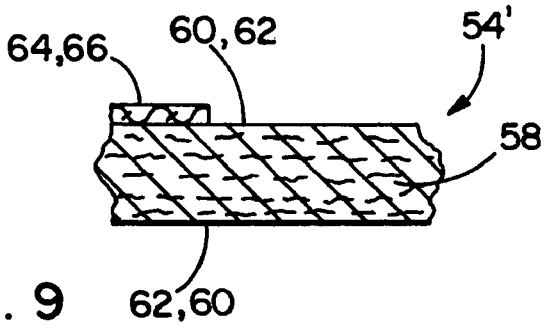

In FIG. 9, a rim 54' is shown defined by the core layer 58, with a cloth layer 64, 66 applied to only a portion of at least one of the upwardly and downwardly facing surfaces 60,62 thereon.

Figure 10:
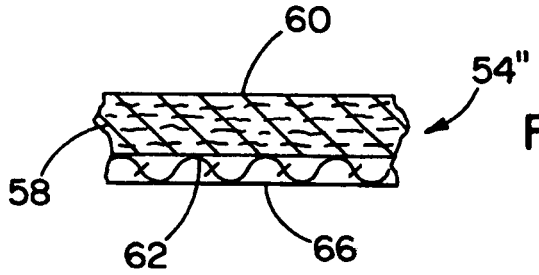

In FIG. 10, a rim 54" is shown wherein the core layer 58 has a cloth layer 66 applied to the downwardly facing surface 62 thereon. The upwardly facing surface 60 on the rim 54" remains exposed.

Figure 11:
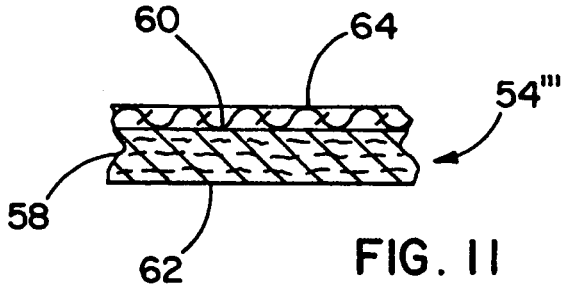

In FIG. 11, a rim 54'" is shown wherein a cloth layer 64 is applied to the upwardly facing surface 60 of the core layer 58, with the downwardly facing surface 62 on the core layer uncovered and, therefore, exposed.

Figure 12:
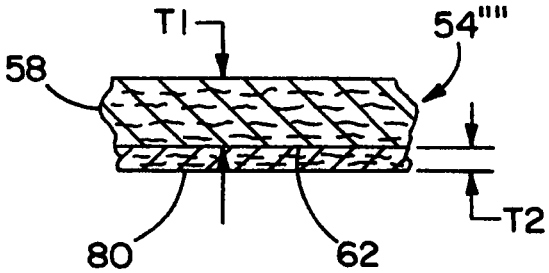

In FIG. 12, a rim 54"" is shown wherein a layer 80 is applied to the downwardly facing surface 62 of the core layer 58. The layer 80 is made from an animal hide or a synthetic animal hide, with the former preferably dressed. The layer 80 is shown to have a thickness T2 that is substantially less than the thickness T1 of the core layer 58. The thickness T2 may be increased to be equal to, and potentially greater than, the thickness T1.

Figure 13:
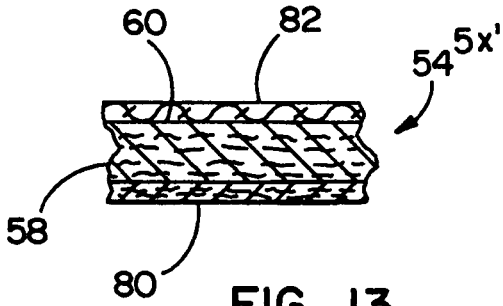

In FIG. 13, a rim $\mathbf{54}^{5x'}$ is shown incorporating the layers 58,80, as in FIG. 12, and further including a cloth layer 82 applied to the upwardly facing surface 60 of the core layer 58.

In all of the embodiments herein, it is contemplated that the joining of layers can be effected through stitching, adhesive, or other means, such as the use of fasteners, etc. These and other joining means may also be used in combination.

Figure 14:
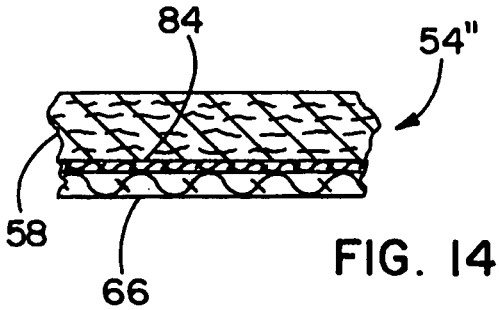

As shown in FIG. 14, the rim 54" may be formed by joining the layers 58,66 through use of an adhesive layer 84.

Figure 15:
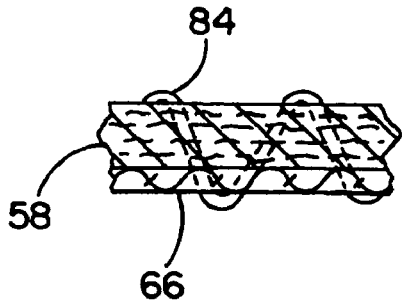

Alternatively, as shown in FIG. 15, the layers 58,66 may be joined by stitching 84.

Figure 16:
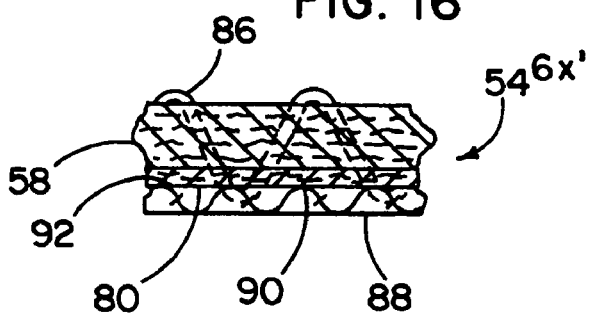

In FIG. 16, a rim at $\mathbf{54}^{6x'}$ is shown wherein the layers 58,80 are joined as in FIG. 12 through stitching 86, with a cloth layer 88 applied to the exposed, downwardly facing surface 90 of the layer 80 through an adhesive 92.

The invention contemplates many other combinations of components to define a rim, in conjunction with a core layer having the animal hide or synthetic animal hide composition. The above are just exemplary component layers and combinations of components layers. Many other combinations are contemplated.

Figure 17:
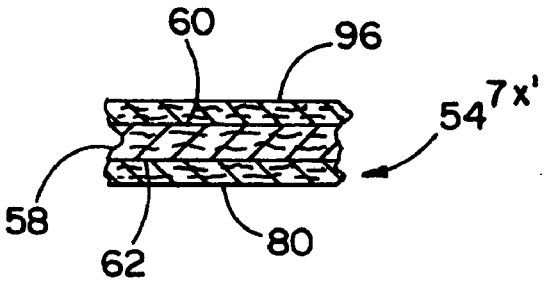

For example, as shown in FIG. 17, a rim $\mathbf{54}^{7x'}$ has a core layer 58 and an animal hide/synthetic animal hide layer 80 applied to the downwardly facing surface 62 thereof, with a separate layer 96, made from animal hide or synthetic animal hide, applied to the upwardly facing surface 60 on the layer 58.

Figure 18:
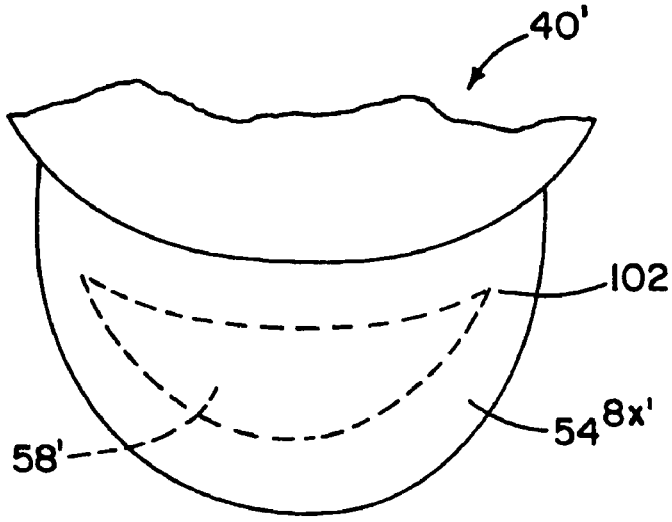
FIG. 18 is a fragmentary, plan view of a baseball-style cap with a modified form of rim, according to the present invention, wherein the core layer does not occupy the full areal extent of the rim.

Another variation contemplated by the invention is shown for a baseball-style cap 40' in FIG. 18. The cap 40' has a rim $\mathbf{54}^{8x'}$ including a core layer 58' made from animal hide or a synthetic animal hide, wherein the core layer 58' has a different configuration, as viewed from above or below, than that of the overall rim. Whereas in the prior embodiments, the core layer 58 extends over substantially the entire areal extent of the exposed upwardly facing rim surface 100 (see FIGS. 3 and 4), the core layer 58' occupies substantial less than the areal extent of the upwardly facing surface 102 on the rim $\mathbf{58}^{8x'}$. The area of the surface 102 that is not underlaid by the layer 58' may include a separate layer of material, or may be defined entirely by one or more cloth layers over-/underlying the core layer 58'.

Figure 19:
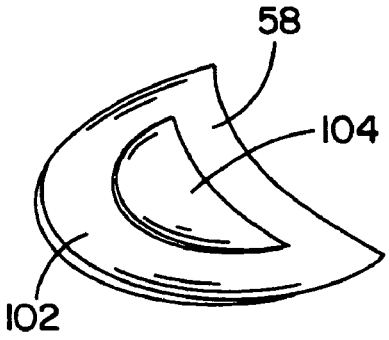
FIG. 19 is a perspective view of a further modified form of rim, according to the present invention, and including two hide layers, with one layer only partially covering the other layer.

Alternatively, the entire surface 102 could be defined by the core layer 58 having an over-/underlying layer 104 having less than the same areal extent, but being made from the same or a like animal hide or synthetic animal hide, as shown in FIG. 19.

The core layer 58,58' may have a uniform thickness over its entire extent or may have a strategically controlled variable thickness to produce the desired properties for the associated rim 54–$\mathbf{54}^{8x'}$.

Figure 20:
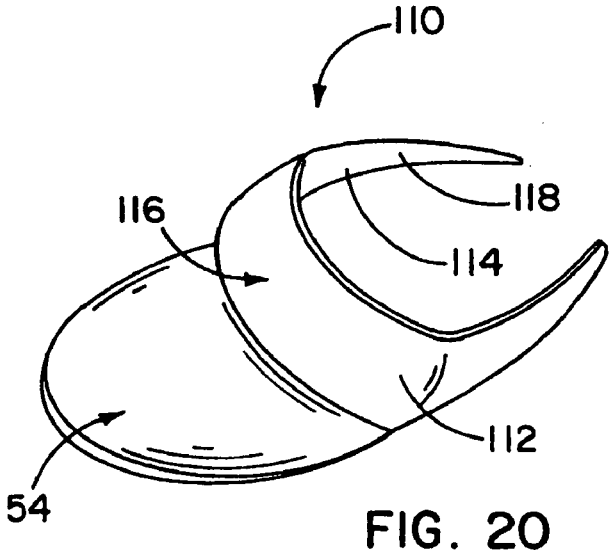
FIG. 20 is a perspective view of another form of headwear piece, in the form of a visor, into which a rim, according to the present invention, is incorporated.

The invention is not limited to incorporation into baseball-style caps. For example, as shown in FIG. 20, a headwear piece is shown at 110 in the form of a visor. The visor 110 has a crown 112 defining a receptacle 114 for the wearer's head. An exemplary, inventive rim 54 is incorporated into the crown 112 to project angularly away therefrom at the forward region 116 of the crown 112. The crown 112 has an opening 118 through which the top portion of a wearer's head is exposed with the visor operatively placed on the wearer's head.

Figure 21:
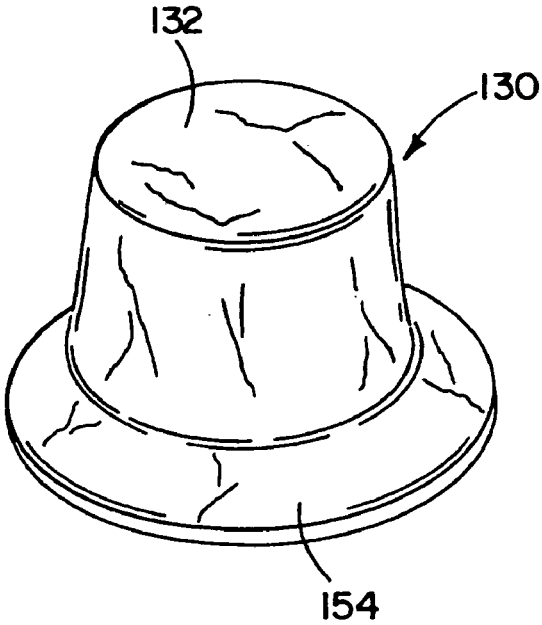
FIG. 21 is a perspective view of another form of headwear piece into which a rim, according to the present invention, is incorporated, and on which the rim extends fully around a crown.

In FIG. 21, another headwear piece, in which the present invention is incorporated, is shown at 130. The headwear piece 130 has a crown 132 and a rim 154, corresponding to the inventive rims 54–$\mathbf{54}^{8x'}$, described above, which rim 154 extends fully around the crown 132. The rim 154 can be constructed in the same manner as described for the rims 54–$\mathbf{54}^{8x'}$, described above.

Figure 22:
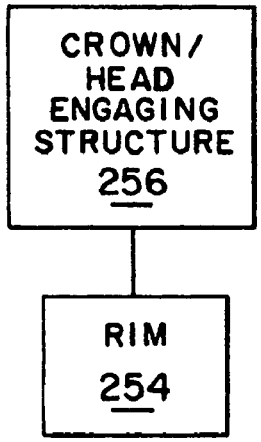
FIG. 22 is a schematic representation of headwear piece with the inventive rim incorporated therein.

As shown generically in FIG. 22, the invention contemplates incorporation of a rim 254, made as previously described, into any type of headwear piece having a crown/head engaging structure, as shown generically at 256.

While the invention has been described with particular reference to the drawings, it should be understood that various modifications could be made without departing from the spirit and scope of the present invention.

The invention claimed is:

1. A headwear piece comprising:

a crown defining a receptacle for the head of a wearer; and a rim projecting angularly away from the crown, wherein the rim comprises: i) a core layer that is made from at least one of: a) an animal hide, and b) a synthetic animal hide, and ii) a second layer, the core layer and second layer formed separately from each other and thereafter joined to each other, wherein the core layer has an upwardly facing surface and a downwardly facing surface, and at least a part of one of the upwardly and downwardly facing surfaces is covered by the second layer.

2. The headwear piece according to claim 1 wherein the core layer has a thickness in the range of 1/16–1/4 inch.

3. The headwear piece according to claim 1 wherein the second layer is applied to the upwardly facing surface of the core layer.

4. The headwear piece according to claim 3 wherein the second layer comprises a cloth material.

5. The headwear piece according to claim 3 wherein the second layer comprises at least one of: a) an animal hide; and b) a synthetic animal hide.

6. The headwear piece according to claim 1 wherein the second layer is applied to the downwardly facing surface of the core layer.

7. The headwear piece according to claim 6 wherein the second layer comprises a cloth material.

8. The headwear piece according to claim 2 wherein the upwardly facing surface of the rim has an area and the core layer extends continuously over substantially the entire area of the upwardly facing surface of the rim.

9. The headwear piece according to claim 1 wherein the rim extends fully around the crown.

10. The headwear piece according to claim 1 wherein the rim extends around only a portion of the crown.

11. The headwear piece according to claim 1 wherein the headwear piece is a baseball-style cap.

12. The headwear piece according to claim 1 wherein the crown has a top opening through which a top region of a wearer's head is exposed with the headwear piece operatively positioned on a wearer's head.

13. The headwear piece according to claim 3 wherein the core and second layers are joined to each other by at least one of an adhesive and stitching.

14. The headwear piece according to claim 6 wherein the core and second layers are joined to each other by at least one of an adhesive and stitching.

15. The headwear piece according to claim 1 wherein the rim has a thickness and the core layer has a thickness equal to at least ½ of the thickness of the rim.

16. The headwear piece according to claim 15 wherein the core layer has a thickness equal to at least ⅔ the thickness of the rim.

17. The headwear piece according to claim 1 wherein the core layer comprises a dressed animal hide.

18. The headwear piece according to claim 1 wherein the second layer is made from at least one of: a) an animal hide; and b) a synthetic animal hide.

19. The headwear piece according to claim 1 wherein the second layer covers substantially the entirety of the at least one of the upwardly and downwardly facing surfaces.

20. The headwear piece according to claim 1 wherein the second layer has an upwardly facing surface and a downwardly facing surface and one of the upwardly or downwardly facing surfaces of the core layer is in contact with one of the downwardly or upwardly facing surfaces of the second layer, the upwardly and downwardly facing surfaces of the core and second layers each has an area, and substantially the entire area of one of a) the one of the upwardly or downwardly facing surface of the core layer and b) the one of the downwardly or upwardly facing surface of the second layer is in contact with the other of a) the one of the upwardly or downwardly facing surface of the core layer or b) the one of the upwardly or downwardly facing surface of the second layer.

21. The headwear piece according to claim 1 wherein the core layer and second layer are joined to each other through stitching.

22. A headwear piece comprising:

a crown defining a receptacle for the head of a wearer; and a rim projecting angularly away from the crown, wherein the rim comprises: i) a first layer that is made from at least one of: a) an animal hide, and b) a synthetic animal hide, and ii) a second layer, the core layer and second layer formed separately from each other and thereafter joined to each other, wherein the first layer has an upwardly facing surface and a downwardly facing surface, and at least a part of one of the upwardly and downwardly facing surfaces is covered by the second layer, wherein the second layer is applied to the upwardly facing surface of the first core layer, wherein there is a third layer applied to the downwardly facing surface of the first layer and at least one of the second and third layers comprises a cloth material.

23. The headwear piece according to claim 22 wherein both of the second and third layers comprise a cloth material.

24. The headwear piece according to claim 22 wherein the core and second layers are joined to each other through stitching.

25. The headwear piece according to claim 22 wherein the core layer is joined to each of the second and third layers by at least one of an adhesive and stitching.

26. A headwear piece comprising:

a crown defining a receptacle for the head of a wearer; and a rim projecting angularly away from the crown, wherein the rim comprises a core layer that is made from a dressed animal hide and a second layer, wherein the core layer has an upwardly facing surface and a downwardly facing surface, and at least a part of one of the upwardly and downwardly facing surfaces is covered by the second layer, wherein the rim has a thickness and the core layer has a thickness equal to at least one-half of the thickness of the rim.

27. The headwear piece according to claim 26 wherein the core layer and second layer are separately formed from each other and thereafter joined to each other.

28. The headwear piece according to claim 27 wherein the core layer and second layer are joined to each other through stitching.

* * * * *